US005865304A

United States Patent [19]

Barnard et al.

[11] Patent Number: 5,865,304

[45] Date of Patent: Feb. 2, 1999

[54] ROTARY-ACTUATED ELECTRICAL SWITCH

[75] Inventors: David A. Barnard, Middlebury; Glenn L. Murphy, Oxford, both of Conn.

[73] Assignee: Hubbell Incorporated, Orange, Conn.

[21] Appl. No.: 905,535

[22] Filed: Aug. 4, 1997

[51] Int. Cl.[6] ..... H01H 19/20; H01H 19/14

[52] U.S. Cl. ..... 200/569; 200/568; 200/564

[58] Field of Search ..... 200/569, 568, 200/564, 336

[56] References Cited

U.S. PATENT DOCUMENTS 3,770,926 11/1973 Wanner ..... 200/166 SD
4,175,220 11/1979 Johnston et al. ..... 200/4
4,400,603 8/1983 Wiley .
4,689,456 8/1987 Martin ..... 200/43.08
4,762,972 8/1988 Roeser ..... 200/302.1
5,594,220 1/1997 Hackbarth et al. ..... 200/6 B

*Primary Examiner*—John D. Yasko
*Assistant Examiner*—Michael J. Hayes
*Attorney, Agent, or Firm*—Jerry M. Presson; Leopold Presser

[57] ABSTRACT

A rotary-actuated electrical switch which is adapted to be utilized for electrical current and preferably alternating current circuits. The operation of the switch is accomplished through the rotation of a handle and the therefrom resulting movements and forces applied to a unique spring-loaded cam and brush lifter assembly.

6 Claims, 3 Drawing Sheets

ROTARY-ACTUATED ELECTRICAL SWITCH

BACKGROUND OF THE INVENTION

1. Field of the Invention

The present invention relates to electrical switches, and in particular, pertains to a novel rotary-actuated electrical switch which is utilized for electrical current and especially alternating current circuits.

The utilization of lever-operated switches for electrical circuits, especially but not limited to alternating current circuits, is well known in the technology, and wherein such switches provide convenient and easily operated devices for the manual switching of electrical current circuits. A considerable number of electrical switches, particularly lever-operated switches which are employed in connection with alternating current circuits have been and are presently employed in industry and are the subject matter of numerous U.S. patents. Such switches generally have the movement of a lever acting directly on a plunger or similar member which, in turn, acts upon electrical contacts to selectively open or close the latter. Other types of electrical switches which are lever-operated incorporate mechanisms in which the lever acts upon a link which pivots in a manner to cause a switch element to effectuate the opening or closing of the electrical contacts. In instances where high electrical currents are interrupted by such switch contacts upon separation between the latter, it is possible that an electrical arc may be formed at the contact surfaces, which may result in the generation of heat and hot gases, thereby necessitating that protective measures be taken to shield the remainder of the switch structure from potentially destructive effects resulting from the generated heat and gases.

2. Discussion of the Prior Art

More recently, lever-operated electrical switches have been developed which are especially adapted for utilization in alternating current circuits, and which to a considerable extent, have improved upon overcoming the shortcomings and drawbacks encountered with earlier similar types of lever-operated electrical switches. An electrical switch of that type which is used for the switching of alternating current circuits employs a lever which is pivoted between an OFF and an ON position, and wherein the lever includes structure connected to a pivotable link and pin assembly operating in opposition to the biasing force of lift springs of a lifter is adapted to be vertically displaced between a contact opening and a contact closing position responsive to the actuation or "throw" of the lever in a generally arcuate motion. For example, an electrical lever-operated switch of that type is known from the disclosure of U.S. Pat. No. 4,400,603 to Wiley; whereas a somewhat similar "on position" motor starting switch is also known and currently manufactured by Bryant Electric Division of Hubbell Corporation, Milford, Conn.

Although the lever-operated electrical switches disclosed in the above-mentioned U.S. patent and those currently being manufactured by Bryant utilize contact-actuating lifters which are acted upon by lifter springs, and wherein the ON and OFF positions between movable and stationary electrical contacts are controlled through the intermediary of a lever handle, the pivoting displacement of which oscillates a link and pin assembly tending to either push the lifter downwardly so as to force a movable brush and contact assembly into a contact-open position, or alternatively to permit the lifter to be urged upwardly responsive to the lifter springs so as to enable the movable and stationary electrical contacts to come into current-conducting engagement.

The above-mentioned lever-operated electrical switches may, at times, be subject to "teasing" action during the movement of the lever between the ON and OFF switching positions, and the manual over- the-center actuation of the lever, upon occasion, causes the switch to be inadvertently hung-up or located in a so-called "tease" position in which the contacts are not quite separated or closed, so as to conceivably cause electrical arcing to take place between the contacts with resultant generation of heat and gases.

SUMMARY OF THE INVENTION

In order to improve upon the foregoing lever-operated electrical switches, particularly such as may be used in but are not limited to alternating current circuits, the present invention contemplates the provision of a unique rotary-actuated electrical switch of the type described, which not only combines the advantages of lever-operated switches, but also eliminates the stresses frequently placed on a typical rotary style switch which necessitates the application of an aggressive positive switching throw, along with being imparted with the capability of performing extensive endurance cycling in order to meet stringent industry standards.

In attaining the foregoing advantages, the present invention relates to a rotary electrical switch, particularly a switch which may be utilized for alternating current circuits, wherein the satisfactory operation of this switch is accomplished through the rotation of a handle and the therefrom resulting movements and forces applied to a unique spring-loaded cam and lifter assembly.

Basically, the cam and lifter assembly imparts a unique operative action to the switch, both in the aspect of a rotary motion feature and in a consistently "tease free" definitive "ON" and "OFF" switching function. The construction of the switch is such as to impact an improvement to the current state-of-the-art relating to such types of electrical switches by eliminating the nuisance problem of a potential so-called "tease" switching position which may upon occasion be encountered in this type of electrical switch device through the use of an improved fluid action and "hands free" over-the-center actuation. The quick over-the-center acceleration of the rotary handle imbues the switch with operative features which provide a user with a clear indication as to electrical contact mating and handle position.

Thus, to be able to achieve the foregoing advantages, the inventive rotary-actuated electrical switch comprises a dually-activated switching mechanism. An upper portion of the mechanism provides for an accelerated handle throw which is necessary for positive switching movement of the brush and contact lifter assembly. This upper portion of the switching mechanism includes a cam and cooperating spring arrangement, such as a leaf spring or compression springs, for imparting a biasing force to the cam, and which is activated upon rotation of the switch handle. A lower portion of the mechanism provides for mechanical structure for contact making and breaking at the required contact pressure and speed of operation. This portion of the mechanism consists of a steep-ramp cam located at the upper end of a spring-biased rectilinearly displaceable brush lifter which respectively opens and closes the electrical contacts of the switch upon actuation of the handle. In effect, the combination of both the upper and lower operative portions of the electrical switch actuating mechanism reduces any stress normally placed on a typical rotary style switch which requires an aggressive positive throw along with a capability of performing extensive endurance switching cycling. The impact of the forces which are generated during contact mating are absorbed by the upper spring mechanism during operation rather than being imparted to the electrical contacts themselves.

Accordingly, it is an object of the present invention to provide a novel rotary switch for use with but not limited to alternating current circuits.

A more specific object of the present invention resides in the provision of a rotary electrical switch of the type described herein, which is employed in controlling the electrical contacts of electrical current circuits, and wherein a dually-activated mechanism of the switch incorporates an upper mechanism portion including a novel cam and leaf or compression spring assembly which is activated upon the rotation of a knob or handle, and wherein a lower portion of the mechanism includes structure for electrical contact making and breaking at a required speed and pressure; with this lower mechanism portion including a steep-ramp cam for cooperation with the cam and spring assembly along with a rectilinearly movable spring-retained brush lifter which opens and closes the electrical contacts responsive to the cam action upon actuation of the rotary switch handle.

BRIEF DESCRIPTION OF THE DRAWINGS

Reference may now be had to the following detailed description of a preferred embodiment of the invention, taken in conjunction with the accompanying drawings, in which.

DETAILED DESCRIPTION OF A PREFERRED EMBODIMENT

Figure 1:
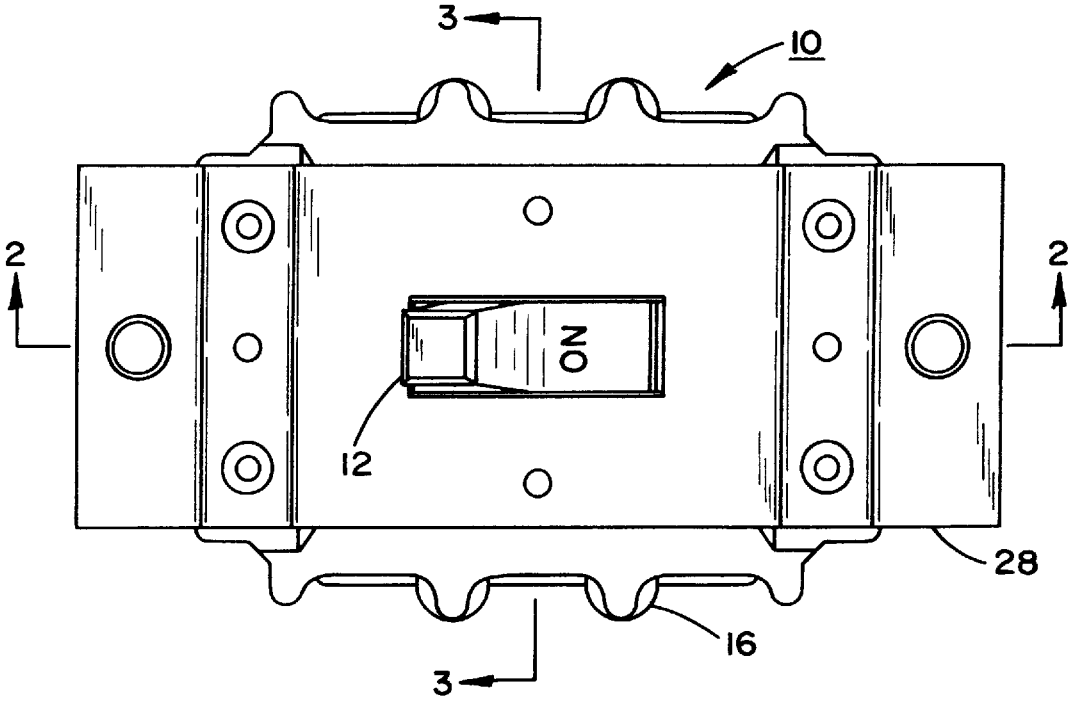
FIG. 1 (PRIOR ART)
FIG. 1 illustrates a plan view of a typical lever-operated electrical switch, which may be an on-position motor starting switch utilized with electrical current circuits, as presently employed in the technology.
Figure 2:
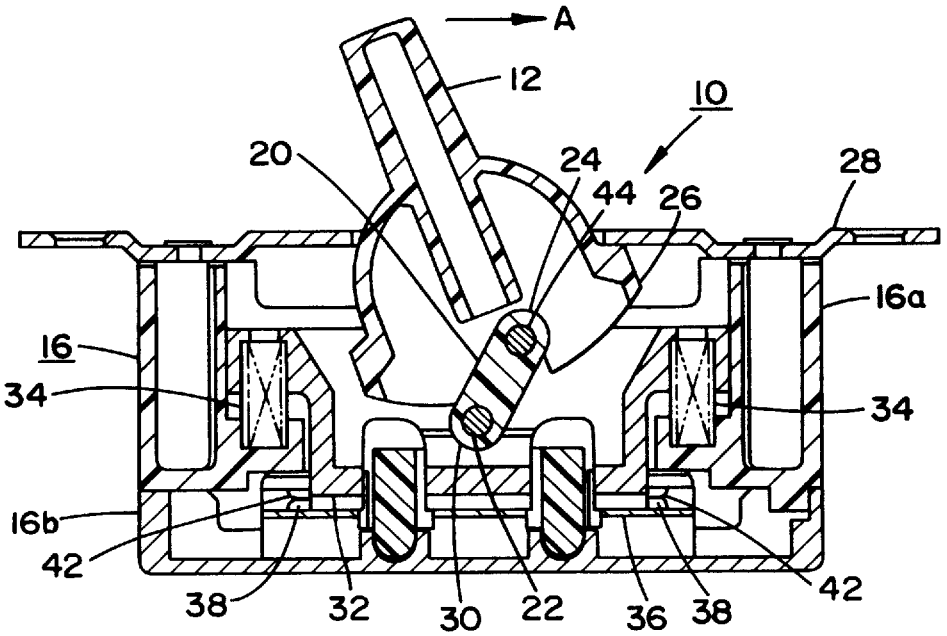
FIG. 2 (PRIOR ART)
FIG. 2 illustrates a sectional view taken along line 2—2 in FIG. 1.
Figure 3:
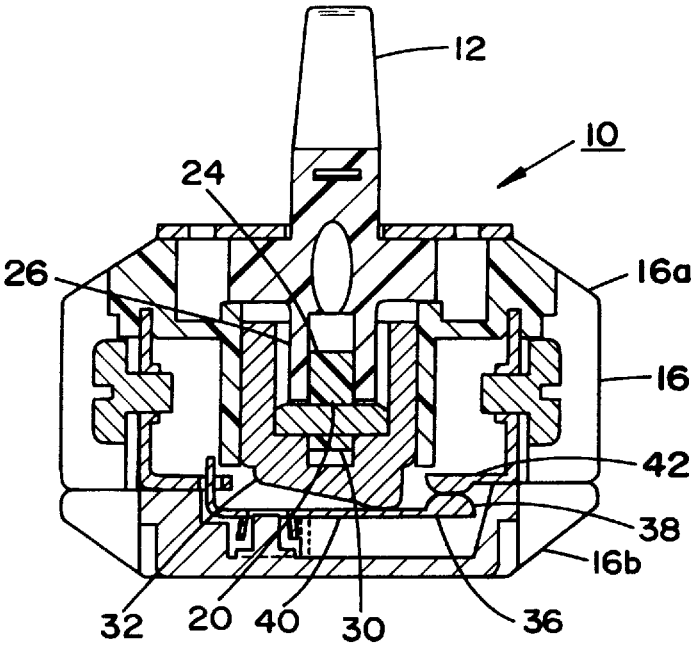
FIG.3 (PRIOR ART)
FIG. 3 illustrates a sectional view taken along line 3—3 in FIG. 1.

Referring now in more specific detail to the drawings, and in particular FIGS. 1 to 3, there is disclosed a lever-operated electrical switch 10 with the operating handle 12 thereof being illustrated in the ON position, in essence; in which the electrical contacts of the switch are in current-conducting contact.

In that instance, the lever-operated electrical switch 10, which is of a type presently in use, includes a housing or enclosure structure 16 of interconnected upper and lower portions 16*a,* 16*b,* and which may be of a suitable insulating material, such as a molded plastic or the like. The switch 10 may be of a three-pole switch configuration, although switches of greater or lesser complexity possessing different numbers of poles may also be employed.

The construction of switch 10, only the essential portions of which required for an understanding of the operation thereof are elucidated herein, includes a mounting arrangement 20 for a link and pin assembly 22 which engages an off-center slot 24 formed in a lower portion 26 of the operating handle 12. The handle 12 is retained within the housing by means of a suitable metallic face plate 28 fastened to enclosure portion 16*a,* 16*b* and utilized for mounting the electrical switch. A lower portion 30 of the link and pin assembly 22 which is adapted to be vertically displaced responsive to actuation of the operating handle 12 engages a brush lifter 32 for rectilinear vertical movement of the latter.

The brush lifter 32 is biased upwardly by means of lifter springs 34 in the ON position of the operating handle so as to permit a movable brush and contact assembly 36 mounting movable electrical contacts 38 on a resilient arm 40 having a fixed fulcrum at an opposite end so as to enable said contacts to be deflected upwardly into contacting engagement with stationary contacts 42 in the enclosure 16. When it is desired to separate the electrical contacts 38, 42 and thereby break the electrical circuit, the operating handle 12 is pivoted into the "OFF" position (towards the right in FIG. 2 in the direction of arrow A), causing the link and pin assembly 22 to be essentially thrown over the off-center operating movement of the upper link pin 44. This will cause the brush lifter 32 to be displaced downwardly opposite the upward biasing force of the lifter springs 34, and to resultantly push the movable brush and contact assembly 36 downwardly by deflecting the resilient arm 40, and disengaging movable contacts 38 from the stationary electrical contacts 42.

As indicated previously, although lever-operated electrical switches for electrical and preferably alternating current circuits provide considerable improvements over earlier designs for lever-type switches, and possibly even over different types of rotary switch constructions, there is still encountered the problems of such switch being placed into a so called "tease" or intermediate position when the operating handle is shifted between one or the other ON or OFF positions.

Figure 6:
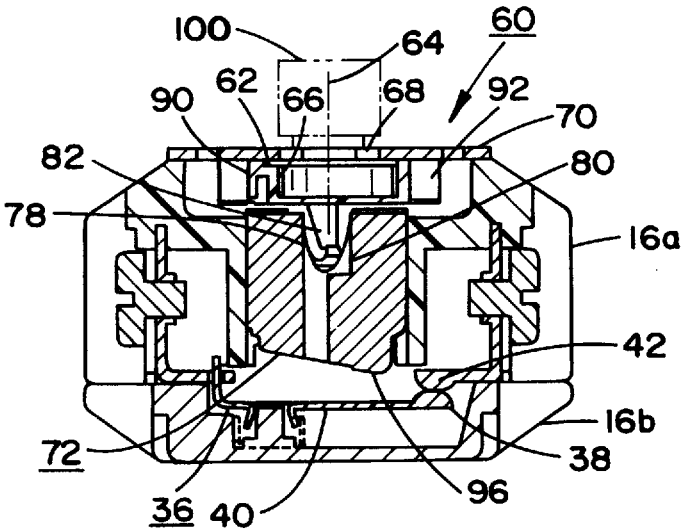
FIG. 6 illustrates a sectional view taken along line 6—6 in FIG. 4.
Figure 4:
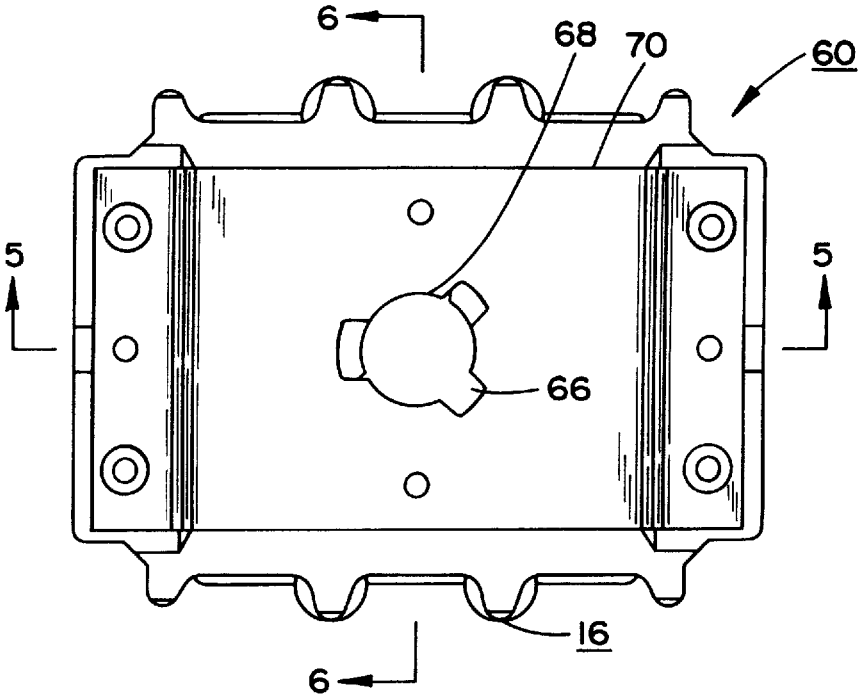
FIG. 4 illustrates a plan view of a rotary electrical switch for use with electrical and preferably alternating current circuits, constructed pursuant to the present invention.
Figure 5:
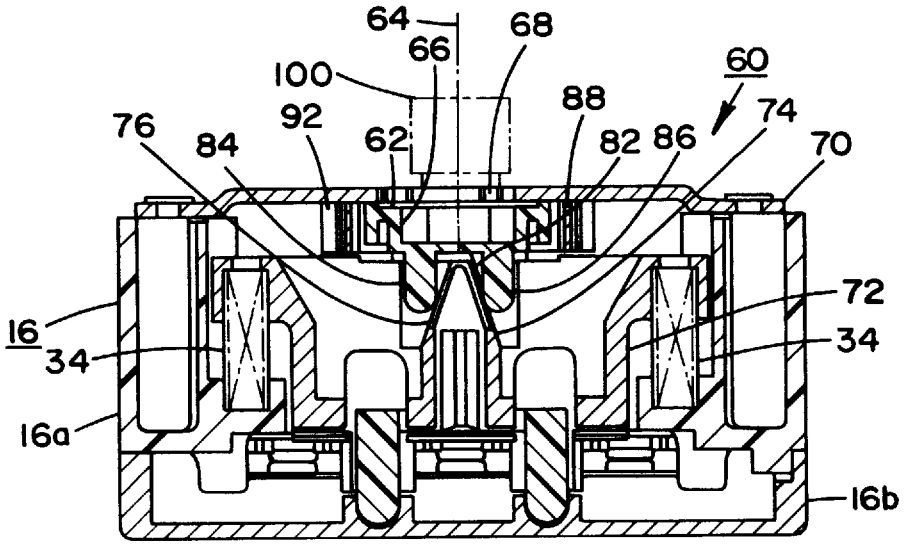
FIG. 5 illustrates a sectional view taken along line 5—5 in FIG. 4.

In order to improve upon the foregoing switch constructions and functioning, as illustrated in FIGS. 4 through 6, the present invention is directed to the provision of a novel rotary electrical switch 60 having a unique dually-operating switching mechanism in the form of a spring and cam structure.

In essence, the inventive electrical switch 60 includes a housing or enclosure structure similar to that of the above-described lever-operated electrical switch 10 and, by way of example only, is described with regard to a three-pole switch construction. Elements of this switch 60 which are similar or identical to those detailed with regard to switch 10 are identified by the same reference numerals.

In this embodiment of the switch 60, the upper portion 16*a* of the enclosure 16 contains a cam structure 62 which is adapted to be rotated about an axis 64 in response to the rotational movement of a suitable knob or handle 100 which includes an actuating portion adapted to engage into a recess 66 of the cam structure by extending through an aperture 68 in a face plate 70.

A brush lifter 72 is, in this instance, also vertically or rectilinearly slidable within the enclosure 16 and is normally upwardly biased by lifter springs 34, as heretofore. At its upper end 74, the brush lifter 72 possesses an upwardly extending ramp 76 of a steep conical configuration and opposite sidewalls 78, 80, one of which is stepped. The sidewalls 78, 80 define a recess 82, and which cooperate in a space between opposite depending walls 84, 86 of the cam structure 62. A cam spring 88 extends about the upper cam portion 90 in the form of preferably a leaf spring structure located in enclosure recess 92 so as to impart a so-called biasing "snapping" action thereto during rotation thereof, which will clearly signify that the rotatable knob or handle has reached one of its ON or OFF switch-operating end positions. Alternatively, instead of a leaf spring 88, there may be employed a plurality of compression springs in the recess 92 spaced about the upper cam portion 90.

As shown more clearly in the drawing FIGS. 5 and 6, the cooperation between the recess 66 and between depending walls 84, 86 in the cam engaging the sidewalls 78, 80 of the steep ramp cam structure 76 on the brush lifter 72 is adapted to impart the vertical rectilinear displacement to the brush lifter responsive to rotation of the cam arrangement between the ON and OFF positions of the knob or handle. Thus, upon rotation of the knob or handle to the OFF position, the camming action will displace the brush lifter 72 downwardly so as to have the lower end 96 thereof contact the resilient arm 40 of movable brush and contact assembly 36 and deflect the resilient arm downwardly so as the place the movable contacts 38 out of contact with the stationary electrical contacts 42 and thereby break the electrical circuit.

Conversely, upon the rotary knob or handle being rotated and "snapped" into an opposite ON position of the switch 60, responsive to the biasing action of the leaf or compression spring 88 exerted on the upper portion 90 of the cam, the steep ramp will be able to move upwardly between the cam surfaces, enabling the brush lifter springs 34 to bias the brush lifter 72 upwardly, and thereby permit the brush and contact assembly 36 constituting the resilient arm 40 and movable electrical contacts 38 to be deflected upwardly into engagement with the stationary electrical contacts 42, thereby closing the electrical circuit.

This particular positive switching action is obtained through the intermediary of an extremely simple construction and operation of the rotary electrical switch 60, and as mentioned heretofore, will reduce the stresses placed on the electrical contacts of a typical rotary style switch, with the lower wall portions 78,80 of the spring-biased cam and the cooperating steep ramp cam 76 of the brush lifter 72 facilitating the secure and advantageous functioning of the rotary switch 60.

The foregoing construction enables the impact of forces encountered during contact mating between the stationary and movable electrical contacts 38, 42 to be absorbed by the spring-biased upper cam mechanism during operation rather than be exerted against the contacts per se, thereby providing a capability for the switch in performing extensive endurance cycling to meet the standards of the electrical industry.

While there has been shown and described what is considered to be a preferred embodiment of the invention, it will, of course, be understood that various modifications and changes in form or detail could readily be made without departing from the spirit of the invention. It is, therefore, intended that the invention be not limited to the exact form and detail herein shown and described, nor to anything less than the whole of the invention herein disclosed as hereinafter claimed.

What is claimed is:

1. An electrical switch, comprising:

(a) at least one stationary contact connected to a conductor;

(b) a contact lever having at least one contact at one end of said lever movable into and out of contact with said at least one stationary contact, said at least one movable contact being connected to a conductor, said contact lever having a fixed fulcrum at an end opposite to the end on which said at least one movable contact is located;

(c) a rectilinearly movable brush lifter movable in directions towards and away from said contact lever;

(d) brush lifter springs operatively connected with said brush lifter for normally biasing said brush lifter in a direction away from said contact lever into a switch ON position;

(e) a cam arrangement in operative communication with an end of said brush lifter distal from said contact lever; said cam arrangement comprising a first cam element supported for rotation in said enclosure at the upper end of said brush lifter; and a second cam element formed at the upper end of said brush lifter in operative connection with said first cam element whereby rotation of said first cam element imparts rectilinear movement to said brush lifter;

(f) operating means connected to said cam arrangement for selectively imparting a force to said brush lifter in opposition to the biasing action of said brush lifter springs so as to cause said brush lifter to move towards said contact lever and to disengage said stationary and movable contacts into a switch OFF position; said operating means comprising a rotary actuator for imparting rotational movements to said cam arrangement, said cam arrangement imparting said rectilinear movement to said brush lifter so as to cause said switch to switch between ON and OFF positions; and (g) spring means engaging said first cam element for biasing said first cam element into predetermined rotational end positions upon rotation of said operating means.

2. An electrical switch as claimed in claim 1, wherein said rotary actuator comprises a rotatable knob or handle element.

3. An electrical switch as claimed in claim 1, wherein an enclosure of an electrically-insulating material encompasses said switch contacts and electrically conductive components, said operating means extending though an aperture in said enclosure to engage said cam arrangement.

4. An electrical switch as claimed in claim 1, wherein said first cam element comprises downwardly depending camming wall structure, and said second cam element comprises upwardly extending steep ramp cam structure operatively communicating with said downwardly depending camming wall structure.

5. An electrical switch as claimed in claim 1, wherein said spring means comprises a leaf spring extending about said first cam element within said enclosure.

6. An electrical switch as claimed in claim 1, wherein said second cam element is integrally formed with said brush lifter.

* * * * *